US006085843A

United States Patent [19]

Edwards et al.

[11] Patent Number: 6,085,843

[45] Date of Patent: Jul. 11, 2000

[54] MECHANICAL SHUT-OFF VALVE

[75] Inventors: A. Glen Edwards, Hockley; Klaus B. Huber, Sugar Land, both of Tex.; Charles van Petegm, Velserbroek, Netherlands; James W. Babineau, Newton, Mass.

[73] Assignee: Schlumberger Technology Corporation, Sugar Land, Tex.

[21] Appl. No.: 09/089,842

[22] Filed: Jun. 3, 1998

[51] Int. Cl.[7] ..... E21B 43/117

[52] U.S. Cl. ..... 166/297; 166/55.1; 166/334.4

[58] Field of Search ..... 166/297, 55, 55.1, 166/334.1, 334.4, 319, 320; 175/4.54

[56] References Cited

U.S. PATENT DOCUMENTS

| | | | |
|---|---|---|---|
| 3,163,225 | 12/1964 | Perkins | 166/334.4 |
| 3,208,355 | 9/1965 | Baker et al. | 91/411 |
| 4,771,831 | 9/1988 | Pringle et al. | 166/319 |
| 4,862,964 | 9/1989 | George etal. | 175/4.54 |
| 5,040,606 | 8/1991 | Hopper | 166/319 |
| 5,293,940 | 3/1994 | Hromas et al. | 166/297 |
| 5,318,126 | 6/1994 | Edwards et al. | 166/297 |
| 5,366,013 | 11/1994 | Edwards et al. | 166/297 |
| 5,429,192 | 7/1995 | Huber et al. | 166/297 |
| 5,509,481 | 4/1996 | Huber et al. | 166/297 |
| 5,509,482 | 4/1996 | Dillon et al. . | |

FOREIGN PATENT DOCUMENTS

| | | |
|---|---|---|
| 0 875 659 A2 | 11/1998 | European Pat. Off. . |
| 2 291 168 | 1/1996 | United Kingdom . |
| 2 320 043 | 6/1998 | United Kingdom . |

*Primary Examiner*—William Neuder
*Attorney, Agent, or Firm*—Trop, Pruner & Hu, P.C.

[57] ABSTRACT

A shut-off valve is disclosed for use in a downhole string of tools in a well. The valve has a housing adapted to be connected between adjacent tools of the string, defining a bore and a passage for hydraulic communication between the adjacent tools. The passage is arranged to intersect the bore, and a piston is slidably disposed within the bore and arranged to block hydraulic communication between the passage and the piston bore. The piston is further arranged to, in a first position, permit hydraulic communication along the passage, and to, in a second position, block hydraulic communication along the passage. The piston also has a bore for ballistic communication between the adjacent tools, such that it can be employed between a firing head and a gun, for instance. Some embodiments also permit circulation flow from the tubing to the well bore after the valve has closed. Methods of use and tool strings containing such valves are also disclosed.

19 Claims, 7 Drawing Sheets

MECHANICAL SHUT-OFF VALVE

BACKGROUND OF THE INVENTION

This invention relates to shut-off valves configured for use in tool strings to be deployed in wells to perform downhole functions.

In completing a product recovery well, such as in the oil and gas industry, several downhole tasks or functions must generally be performed with tools lowered through the well pipe or casing. These tools may include, depending on the required tasks to be performed, perforating guns that ballistically produce holes in the well pipe wall to enable access to a target formation, bridge plug tools that install sealing plugs at a desired depth within the pipe, packer-setting tools that create a temporary seal about the tool and valves that are opened or closed.

Sometimes these tools are electrically operated and are lowered on a wireline, configured as a string of tools. Alternatively, the tools are tubing-conveyed, e.g. lowered into the well bore on the end of multiple joints of tubing or a long metal tube or pipe from a coil, and activated by pressurizing the interior of the tubing. Sometimes the tools are lowered on cables and activated by pressurizing the interior of the well pipe or casing. Other systems have also been employed.

SUMMARY OF THE INVENTION

The invention features a shut-off valve for use in a tubing-conveyed string of tools. The shut-off valve is configured to automatically close in response to a downhole event to enable the tubing to be subsequently pressurized to activate a tool in the string. The downhole event causing the closing of the valve can include such events as the detonation of an attached, ballistically-activated tool, or the development of a leak between the tubing pressure system and the well bore, or another event, planned or otherwise, which exposes the ends of the valve piston to well bore pressure.

One aspect of the invention provides a shut-off valve for use in a downhole string of tools in a well. The valve includes a housing and a piston. The housing has two ends adapted to be connected to adjacent tools of the string, and defines both a bore between the two ends and a passage (intersecting the bore) for hydraulic communication between the two ends. The piston is slidably disposed within the bore and defines a bore for ballistic communication between the two housing ends. The piston is arranged to block hydraulic communication between the passage and the piston bore. The piston is also arranged to, in a first position, permit hydraulic communication along the passage, and to, in a second position, block hydraulic communication along the passage.

In some cases, the piston is adapted to be moved by piston bore pressure from the first position to the second position.

Some embodiments also have a lock to retain the piston in the second position after it is moved from the first position.

In some embodiments, the valve also contains a first ballistic element attached to one end of the piston, and a second ballistic element attached to the housing, such that the first and second ballistic elements are relatively moved away from each other as the piston moves to its second position. Some valves of the invention also have a shield attached to the housing along its bore between the first and second ballistic elements and arranged to shield the second ballistic element from a detonation of the first ballistic element when the piston is in the second position. The shield may be pivotably attached to the housing and biased toward a detonation-blocking position.

In some embodiments, the housing defines a port between its bore and ambient well pressure. The piston is arranged to, in its first position, block hydraulic communication between the port and the passage and, in its second position, permit hydraulic communication between the port and the passage.

In some cases, the piston defines a first transverse area and a second transverse area. The first transverse area is exposed to ambient well pressure, such that ambient well pressure acts to force the piston toward its first position. The second transverse area is exposed to housing passage pressure, such that passage pressure acts to force the piston toward its second position. In such cases, the piston is responsive to the instantaneous difference between tubing pressure and local well bore pressure.

In some other cases an air chamber is defined between the piston and housing, such that the piston is responsive to absolute tubing pressure instead of to an instantaneous difference between tubing pressure and local well bore pressure. The air chamber is arranged to decrease in volume as the piston moves to the second position.

According to another aspect, a shut-off valve is provided for use between two tools of a downhole string of tools in a well. The valve includes a housing and a piston. The housing has an inner bore and is adapted to be connected to the two tools. The housing defines a passage for hydraulic communication between the two tools, the passage intersecting and crossing the housing bore. The piston is slidably disposed within the bore and has a first ballistic element for transferring a detonation between the two tools. The piston is arranged to, in a first position, permit hydraulic communication along the passage, and to, in a second position, block hydraulic communication along the passage.

According to another aspect, the invention provides a string of tools to be lowered into a well on tubing for performing a series of downhole functions. The string has an internal hydraulic conduit extending along the string for hydraulic communication between the tubing and tools of the string. The string includes a hydraulically-activatable tool adapted to be activated by pressure conditions within the conduit, a hydraulically-activatable firing head below the tool and adapted to be activated by pressure conditions within the conduit, a ballistically-activatable tool below the firing head and adapted to be activated by a ballistic detonation from the firing head, and the shut-off valve described above. The shut-off valve is arranged between the firing head and the ballistically-activatable tool. The valve housing has an inner bore and a passage, the passage intersecting the bore and forming a portion of the conduit. The piston is slidably disposed within the housing bore and has a bore for transferring the detonation. As described above, the piston is arranged to, in a first position, permit hydraulic communication along the passage, and to, in a second position, block hydraulic communication along the passage. The piston is adapted to be moved to its second position as a result of the detonation to enable the subsequent hydraulic activation of the hydraulically-activatable tool.

According to another aspect of the invention, a method of performing a downhole function in a well with a string of tools is provided. The method includes the steps of:

(1) assembling the string of tools to include the above-described shut-off valve between two tools of the string;

(2) lowering the assembled string of tools into a well; and (3) initiating a detonation through the shut-off valve, the detonation causing the piston to be moved to its second position to block hydraulic communication along the passage.

In some embodiments, the two tools include a hydraulically-activatable firing head and a ballistically-activatable tool.

In some cases the string of tools contains at least one other hydraulically-activatable tool above the shut-off valve, in which case the method also includes, after the step of initiating the detonation, the step of applying pressure to an upper end of the passage to activate the other hydraulically-activatable tool.

The valve of the invention can reliably and automatically close off the internal activation pressure conduit of a tool string from well bore pressure to allow the activation pressure to be raised for a subsequent activation. The invention can also provide, in some embodiments, for recirculation between the tubing and well bore after closing. The undesirable detonation of a leaking gun can also be avoided, as the valve is adapted to disarm the gun in response to such a leak by physically separating ballistic transfer charges. Other advantages will also be apparent from the following description and claims.

DESCRIPTION OF EMBODIMENTS

Figure 1:
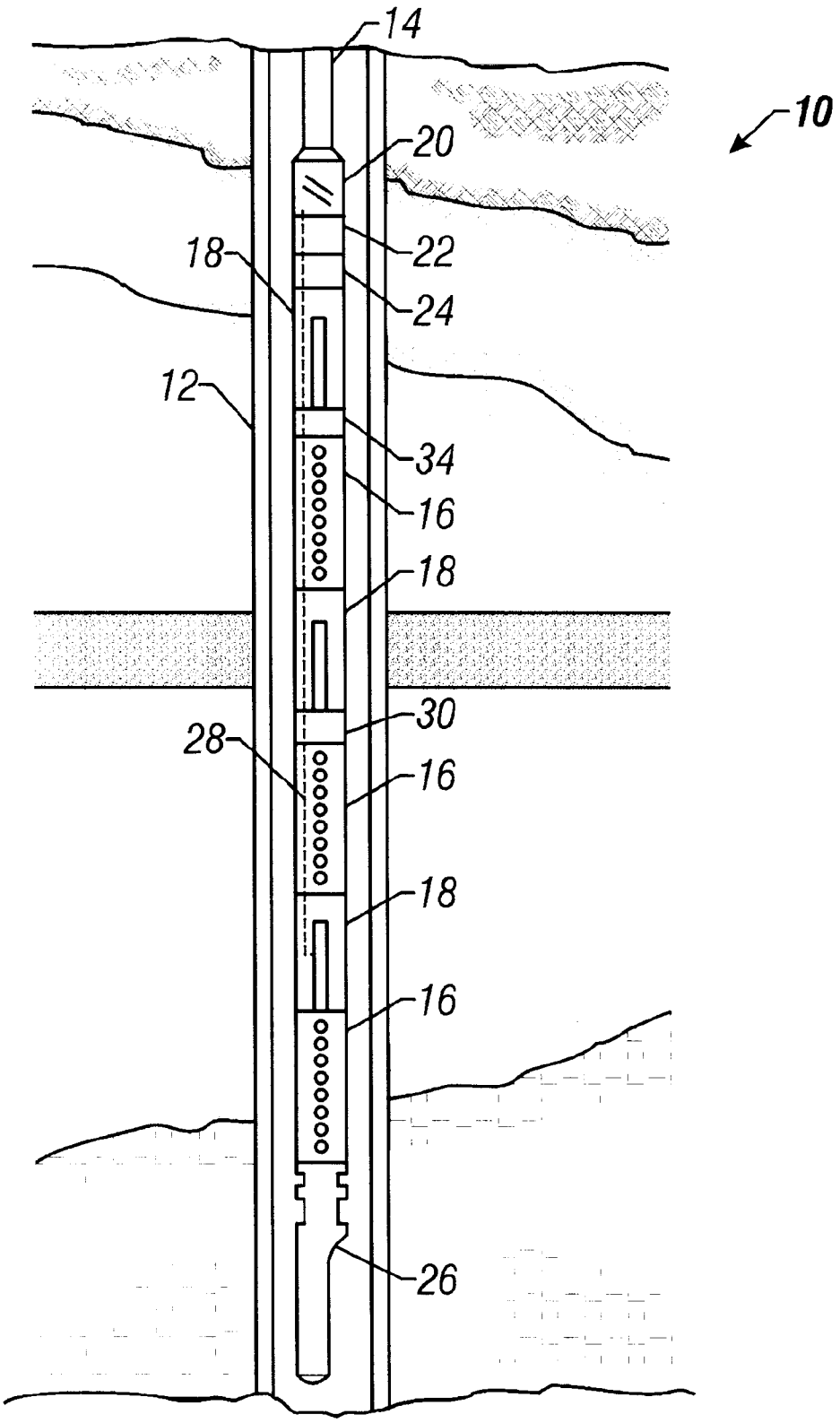
FIG. 1 illustrates a tubing-conveyed tool string deployed in a well.

Referring to FIG. 1, a completion tool string 10 is deployed in an oil well casing 12 on the end of tubing 14. The string includes three guns 16 for perforating the well casing and surrounding geology, each arranged below a corresponding, hydraulically-activated firing head 18. An example of a hydraulically-activated firing head for use in a multiple-tool string is disclosed in copending U.S. Pat. application Ser. No. 08/752,810 by Edwards, et al., the content of which is incorporated herein by reference. A flapper valve 20, a circulation valve 22 (e.g., a ball drop circulation valve), and a swivel 24 are made up between the tubing and the upper firing head, as is known in the art of tubing-conveyed well completion. Circulation valve 22 (sometimes referred to in the art as a circulating valve) is open as the tools are run into the well, enabling fluid to be pumped down the tubing and out into the well bore. When it is desired to increase tubing pressure, the valve is closed (e.g., by dropping a ball down the tubing to shift a sleeve to plug the valve). At the bottom of the string is an eccentric weight 26 for gun alignment in deviated or horizontal wells.

Firing heads 18 are constructed to be activated by a preprogrammed sequence of pressure conditions received from the surface of the well via tubing 14. An internal hydraulic conduit 28, illustrated as a dashed line, supplies tubing pressure to all of the firing heads. Conduit 28 extends through the upper and middle guns 16 to reach the lower firing head. When the predetermined sequence of tubing pressure conditions has been received at a given firing head 18, that firing head detonates a length of primacord extending into its associated gun 16, thereby detonating the shaped, directed charges in the gun to perforate the well casing and surrounding geology.

String 10 is constructed to be fired in a bottom-up sequence, with the bottom head 18 firing first and the upper head 18 firing last. After reaching the first firing depth, a ball is dropped to plug recirculation valve 22 to enable tubing 14 to be pressurized to fire the bottom gun 16. After the bottom gun is detonated, a further sequence of elevated pressures transmitted through tubing 14 fires the middle head 18 to detonate the middle gun 16 which, when detonated, breaches internal conduit 28 passing through the gun. To enable further pressurization of tubing 14 for firing the upper head 18, a mechanical shut-off (MSO) valve 30 is made up between the middle firing head and the middle gun. As explained in more detail below with respect to FIGS. 2 and 3, MSO valve 30 is hydraulically activated and closes off internal conduit 28 passing through it, upon detonation of the middle gun 16. With internal pressure integrity restored to the hydraulic activation system, tubing 14 may be further pressurized to activate the upper firing head. To enable hydraulic fluid to be circulated from tubing 14 out into the well bore 32 after activation of all tools in the string, a mechanical shut-off/circulation (MSC) valve 34 is made up between the upper firing head 18 and the upper gun 16. As explained in more detail below with respect to FIGS. 4 and 5, MSC valve 34 is hydraulically activated and, upon detonation of the upper gun 16, opens a passage between conduit 28 and well bore 32 to enable flow between the tubing and the well bore for circulation (e.g., as the tool string is retracted).

Figure 2:
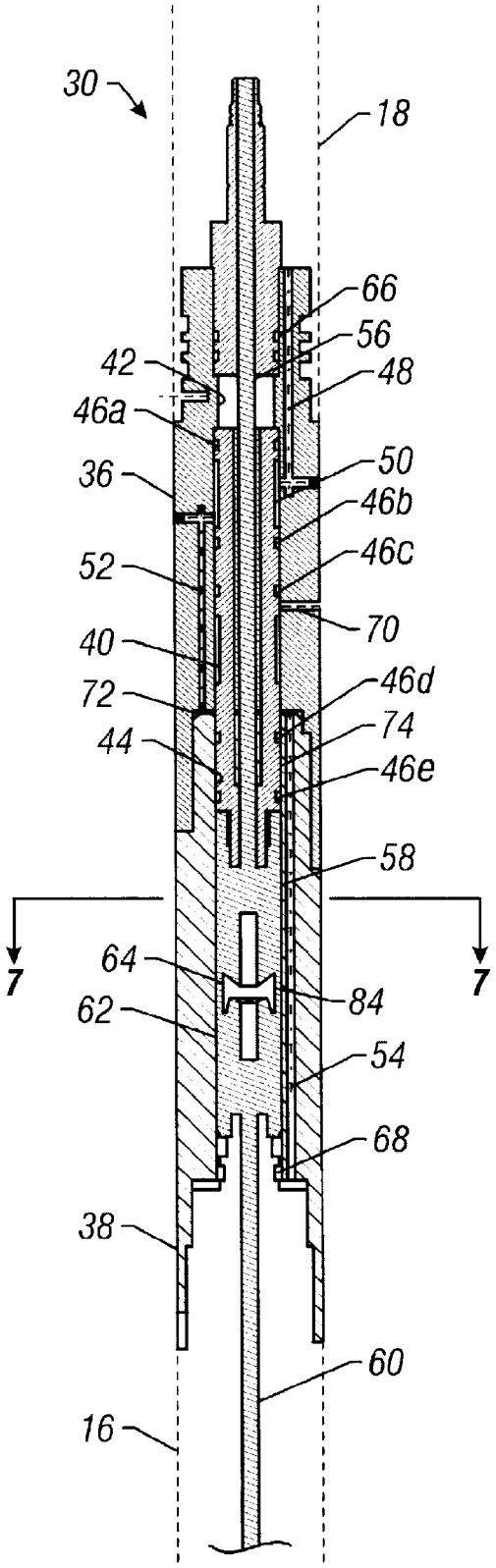
FIGS. 2 and 3 are cross-sectional views of a first embodiment of a shut-off valve, in its open and closed positions, respectfully.

Referring to FIG. 2, MSO valve 30 has an upper housing 36 and a lower housing 38, joined at a sealed, threaded connection. The upper and lower housings are shown joined at sealed, threaded connections to a firing head 18 and a gun 16 (in dashed outline), respectively. The valve is shown in its as-assembled condition (e.g., as when running into the well), with the internal conduit open for flow and/or pressure transmission through the valve. The valve has a piston 40 slidably disposed within coaxial, internal bores 42 and 44 of the upper and lower housings, respectively, and carries five o-ring seals (46*a*–*e*) spaced along its length. Seals 46*a*, 46*b* and 46*c* are all standard size 213 o-rings in this embodiment, while seal 46*d* is a size 216 o-ring and seal 46*e* is a size 215 o-ring.

The internal pressure conduit is provided through MSO valve 30, from top to bottom, via four parallel upper passages 48, a cavity 50 about piston 40 between seals 46*a* and 46*b*, four parallel passages 52 (one shown) which are open to piston 40 between seals 46*d* and 46*e*, and four parallel passages 54 (one shown). Passages 48 and 54 communicate, at either end of the MSO valve, with corresponding passages (not shown) in the firing head and gun. In the condition illustrated in FIG. 2, the valve is open such that the firing head and gun at either end of the valve are in hydraulic communication through this internal pressure conduit.

MSO valve 30 also provides ballistic (i.e., pyrotechnic) communication between firing head 18 and gun 16. A length 56 of primacord is arranged to be ignited by firing head 18 and extends downward through piston 40 to an upper transfer charge 58. Another length 60 of primacord runs from a lower transfer charge 62 into gun 16 for detonating the gun. The upper and lower transfer charges are separated by a small air gap 64 across which the detonation of upper transfer charge 58 ignites lower transfer charge 62. As is known in this art, the primacord and charges should be kept dry until detonated. Within the MSO valve, the air cavities that contain the ballistic elements are sealed, from top to bottom, by o-ring seals 66, 46*a* and 46*e*, and by o-ring seal 68 in the upper portion of gun 16. After the attached gun has been detonated, the air cavities sealed by these o-rings are flooded by well fluids flowing upward into the valve through the primacord passage of the gun.

Piston 40 remains in the position shown in FIG. 2 as the tool string is run into the well. Tubing pressure exerts a net upward force on the piston by acting on the differential pressure area between o-ring seals 46*d* and 46*e*. There is no net longitudinal force applied by tubing pressure acting between seals 46*a* and 46*b*, as they create no differential pressure area. Well bore pressure, applied through a port 70 in upper housing 36, provides a net downward force on piston 40 by acting on the differential pressure area between o-ring seals 46*c* and 46*d*. Running in the hole, the difference between tubing pressure and well bore pressure is low (any pressure elevation is due primarily to restrictions in the circulation valve 22 shown in FIG. 1). Consider, for example, a shut-off valve intended to be operated at a depth corresponding to a hydrostatic well bore pressure of about 1800 pounds per square inch (psi), pushing the piston downward. For activating the firing heads, tubing pressure may have to be elevated to about 3500 psi, pushing the piston upward. Acting in opposition on the piston, these quasi-static pressures are insufficient to overcome friction to move piston 40.

When the associated gun 16 is fired, the local well bore pressure (also called rat hole pressure or annulus pressure) drops very quickly as nearby well bore fluids move out into the perforations formed by the detonation. Meanwhile, the tubing pressure does not drop as quickly, due in part to the inherent flow restrictions of the internal conduit in combination with the viscosity of the hydraulic fluid. The local drop in well bore pressure reduces the downward force applied to piston 40 between seals 46*c* and 46*d*, and the tubing pressure, acting between seals 46*d* and 46*e*, moves piston 40 upward to the position shown in FIG. 3, where a c-ring 72 held between the upper and lower housings snaps into a slot 74 in the piston and prevents further piston motion.

Figure 3:
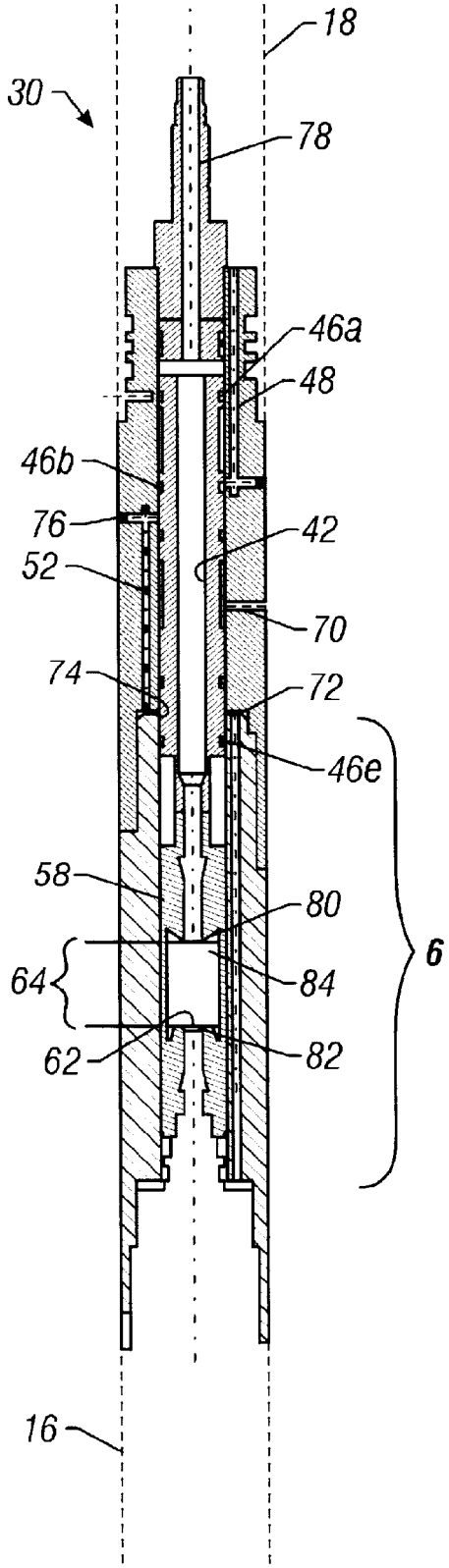

Referring to FIG. 3, the MSO valve 30 is shown in its closed position. The above-described upward movement of piston 40 (caused by pressure forces) has blocked further hydraulic communication between passages 48 and 52, as the entrance ports 76 of passages 52 have been traversed by o-ring seal 46*b*. Consequently, passages 48 (and connected passages above the MSO valve, including tubing 14 of FIG. 1) can be repressurized for activating additional firing heads, such as the upper head 18 of FIG. 1. Not shown in this figure, the cavity 78 formerly housing primacord 56 (FIG. 2) is plugged at its upper end by the firing pin within the attached firing head 18.

The MSO valve 30 also prevents detonation of a leaking gun. As shown in FIG. 3, the upward movement of piston 40 has also moved the upper transfer charge carrier 80, which formerly housed upper transfer charge 58 (FIG. 2) and is attached to piston 40, away from the lower transfer charge carrier 82, which formerly housed lower transfer charge 62 and is attached to gun 16. In the event of a leak in the gun prior to detonation, well bore pressure is applied, through the gun primacord bore, to the lower end of piston 40 to act against size 215 seal 46*e* and, via the internal bore 92 of piston 40, to the upper end of the piston to act against size 213 seal 46*a*. Because of the differential pressure area defined between these two seals, well bore pressure acting through the leaking gun creates a net upward force on piston 40. Combined with the upward piston force caused by the next subsequent increase in tubing pressure, friction and the downward force exerted on the piston through port 70 are overcome and the piston is moved upward where it is locked in place by ring 72. Thus applying a potentially activating pressure rise in the tubing will close the MSO valve 30 above a leaking gun and separate the transfer charges 58 and 62 to prevent the transfer of a detonation across the widened gap 64 between the charges.

Figure 6:
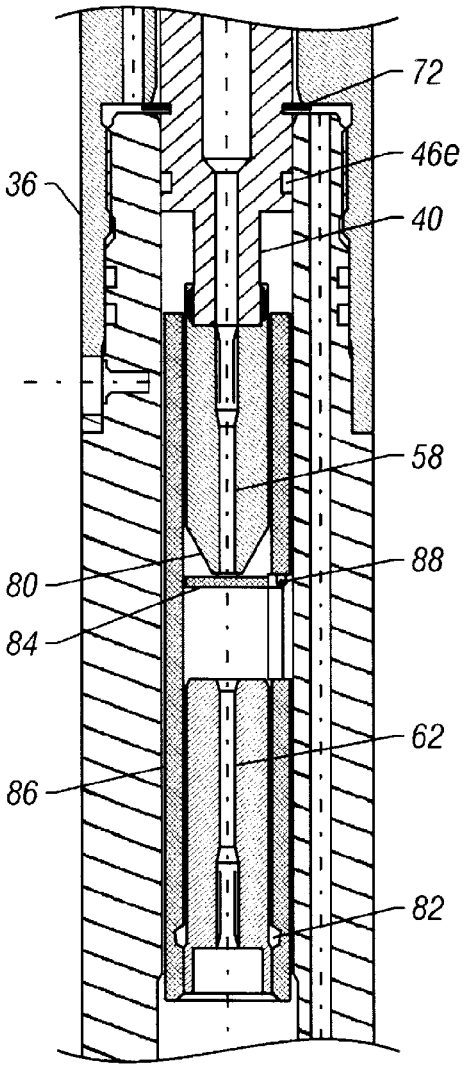
FIG. 6 is an enlarged view of area 6 in FIG. 3.
Figure 7:
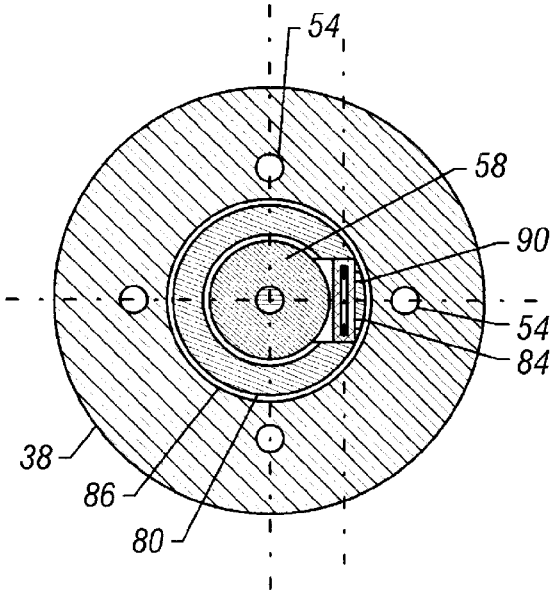
FIG. 7 is a cross-sectional view of the first shut-off valve embodiment, corresponding to line 7—7 of FIG. 2.

Referring also to FIGS. 6 and 7, the MSO valve also contains a mechanical shield to further help to avoid a ballistic transfer between the two transfer charges 58 and 62 in the event of an internal leak. As shown in these figures, the upward movement of upper transfer charge carrier 80 has caused a spring-loaded flap 84, which is mounted in the side of a sleeve 86 extending upward from gun 16, to swing inward against the end of carrier 80. Flap 84 is arranged to pivot about a pin 88 and biased to swing inward by a torsional spring 90 about the pin. Flap 84 provides no seal against the end of carrier 80, but acts to help deflect and absorb the percussion of the detonation of charge 58.

Figure 4:
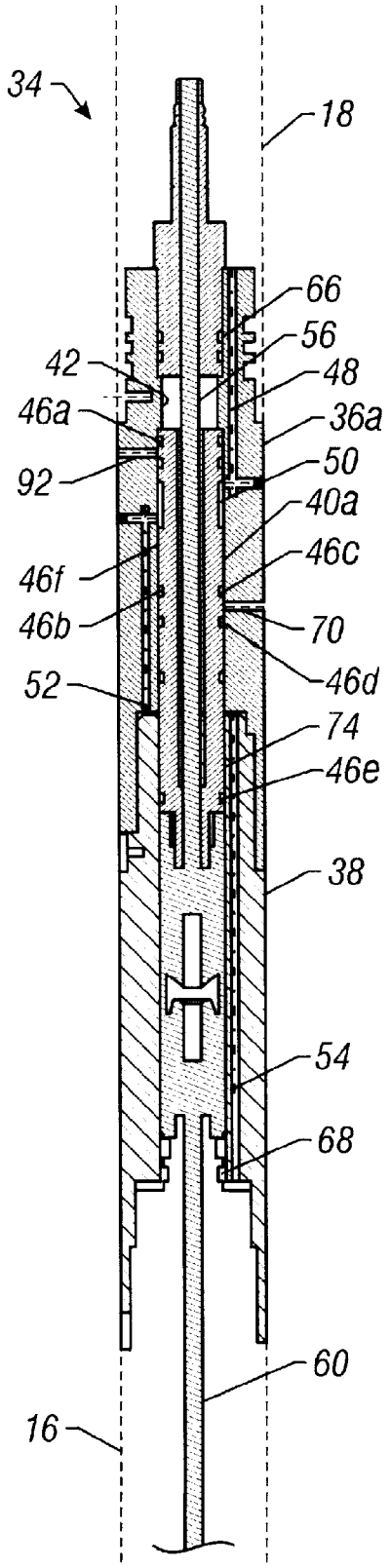
FIGS. 4 and 5 are cross-sectional views of a second embodiment of a shut-off valve, a shut-off/recirculation valve, in its open and closed positions, respectfully.
Figure 5:
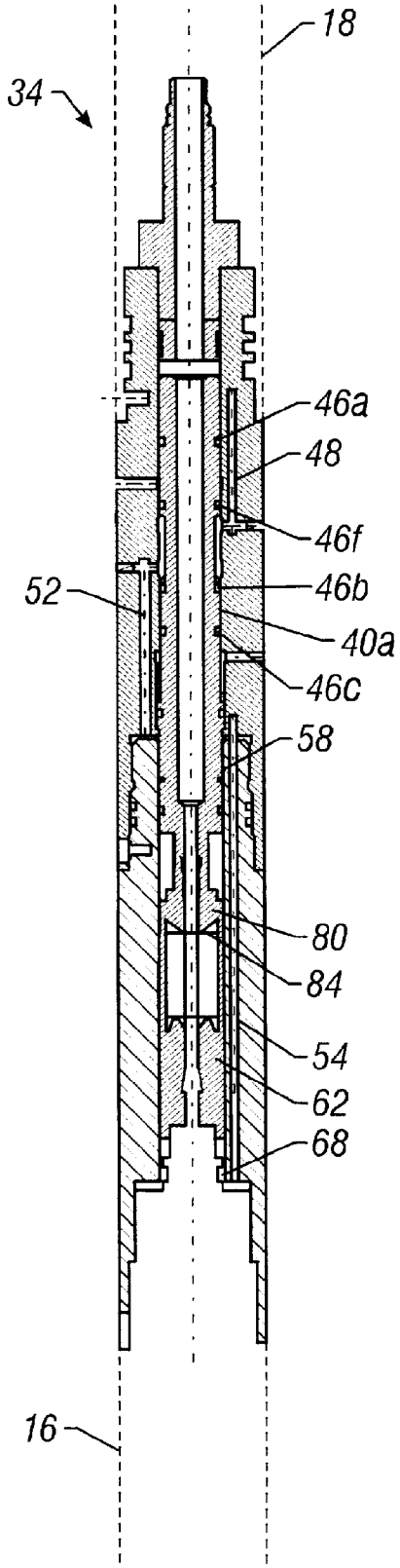

FIGS. 4 and 5 illustrate the structure and operation of a second version of the mechanical shut-off valve, referred to as a mechanical shut-off/circulation (MSC) valve 34 and shown made up in the tool string of FIG. 1 between the upper firing head and gun. The MSC 34 provides the added function of enabling circulation from the tubing to the well bore after the valve has closed. The significant differences between MSC 34 and MSO 30 are that the piston 40*a* of the MSC is longer and contains an additional size 213 o-ring seal 46*b*, and that there is a recirculation port 92 through the side wall of upper housing 36*a*. Cavity 50 is sealed at either end by seal 46*f* and 46*b*. Shown in the open position in FIG. 4, flow through recirculation port 92 is blocked by seals 46*a* and 46*f* and well bore pressure acting through port 92 creates no net axial force on piston 40*a*. With the MSC closed as shown in FIG. 5 (i.e., with piston 40*a* moved upward), passage 48 is in hydraulic communication with port 92 through cavity 50 between seals 46*f* and 46*b*. In this position, hydraulic fluid may be recirculated from the tool string out into the well bore as the string is retrieved.

Figure 8:
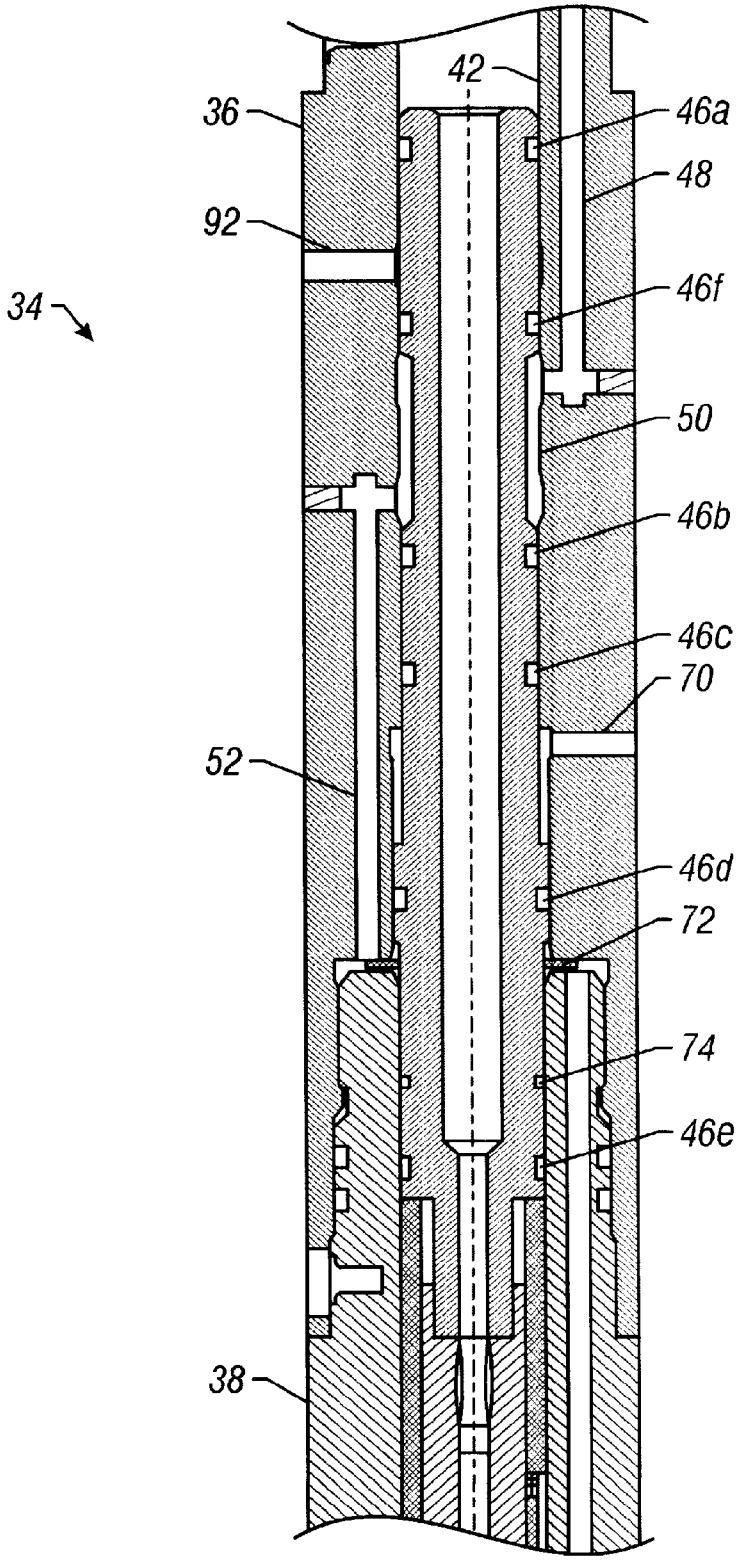
FIG. 8 is an enlarged view of the piston of the shut-off/recirculation valve of FIG. 4, with the primacord removed.

FIG. 8 shows the MSC piston 40*a* in its open position, with the primacord removed for clarity. To review the hydraulic forces acting axially upon the piston in the absence of an internal leak in the attached gun, the following pressures act upon the following net seal areas. Tubing pressure acts upward against seal 46*f* and downward against seal 46*b*, and upward against seal 46*d* and downward against seal 46*e*, creating a net upward force due to the difference in seal areas between seals 46*d* and 46*e*. Rat hole pressure acts upward against seal 46*a* and downward against seal 46*f* through recirculation port 92, and acts upward against seal 46*c* and downward against seal 46*d* through port 70, creating a net downward force due to the difference in seal areas between seals 46*c* and 46*d*. Only pneumatic loads are exerted between seals 46*b* and 46*c*, downward against seal 46*a* and upward against seal 46*e*, of negligible effect.

Figure 9:
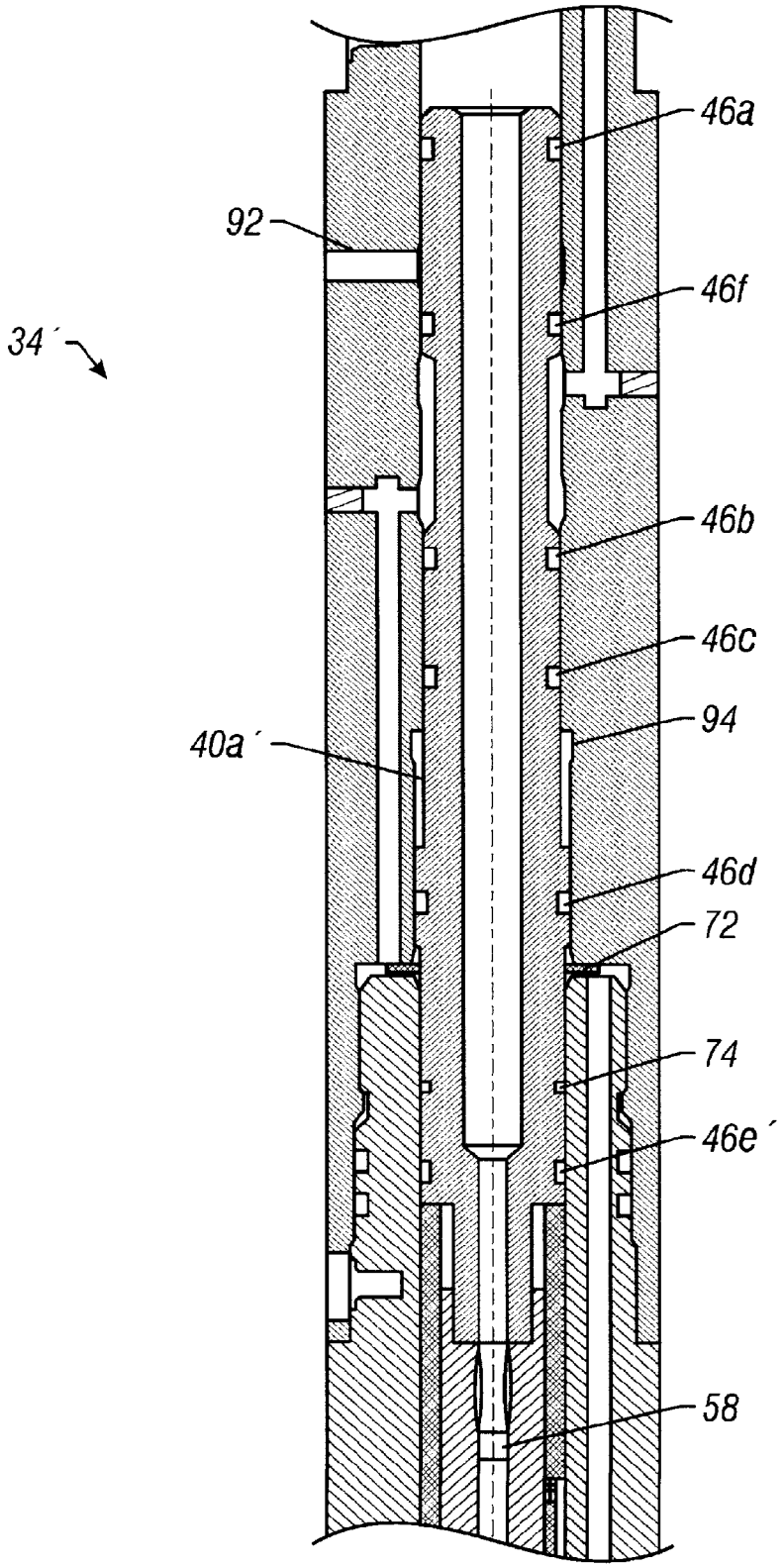
FIG. 9 is a cross-sectional view of a third embodiment of the shut-off valve.

FIG. 9 illustrates a second embodiment of the MSC valve, labelled 34'. The significant differences between MSC 34' and MSC 34 of FIG. 8 are that port 70 has been removed between seals 46*c* and 46*d*, and that the diameter of seal 46*e*' is the same as that of seal 46*d* (size 216). Running into the hole in the open position shown and in the absence of a gun leak, there is no net hydraulic force acting to move the piston. Tubing pressure acts upward against seal 46*f* and downward against seal 46*b*, and upward against seal 46*d* and downward against seal 46*e*', creating no net upward force due to the equality in seal areas. Rat hole pressure acts upward against seal 46*a* and downward against seal 46*f* through recirculation port 92, also creating no net upward force due to the equality in seal areas. Chamber 94 between seals 46*c* and 46*d* contains air at atmospheric pressure. In the event of a gun leak or in consequence of a gun detonation, rat hole pressure is also applied upward against seal 46*e*' and downward against seal 46*a*, creating a net upward force on piston 40*a*' due to the difference in seal areas between seal 46*e*' and 46*a*. This net upward force moves piston 40*a*' and its attached transfer charge 58 upward, collapsing air chamber 94, until ring 72 seats in groove 74.

Figure 10:
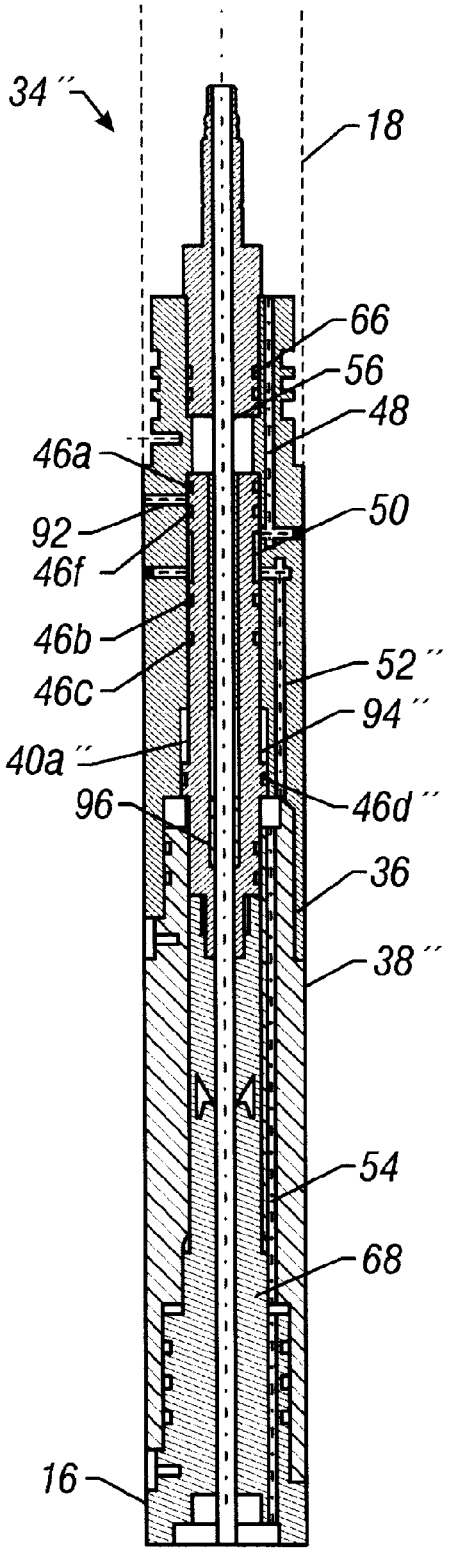
FIGS. 10 and 11 are cross-sectional views of a fourth embodiment of a shut-off valve, in its open and closed positions, respectfully.

FIG. 10 illustrates yet another MSC embodiment, differing from the embodiment of FIG. 4 in key aspects. First, MSC valve 34" is configured with an air chamber 94' similar in function to the air chamber 94 of the embodiment of FIG. 9. Seal 46*d*" is of significantly larger diameter than seal 46*a*, to create a significant upward force on piston 40*a*" when the internal ballistic cavities are exposed to well bore pressure by either a leaking tool or a detonation. Second, there is no o-ring seal 46*e* about the piston 40*a*". Rather, an o-ring seal 96 is disposed between lower housing 38" and upper housing 36" to seal the ballistic cavities from passages 52" and 54. Third, there is no sleeve 86 or flap 84, as in the embodiment of FIG. 4. Fourth, there is no locking ring 72, as in FIG. 4. Piston 40*a*" is held in its closed, recirculating position (FIG. 11) by seal friction and well bore pressure acting through the gap about the upper charge carrier 80.

Figure 11:
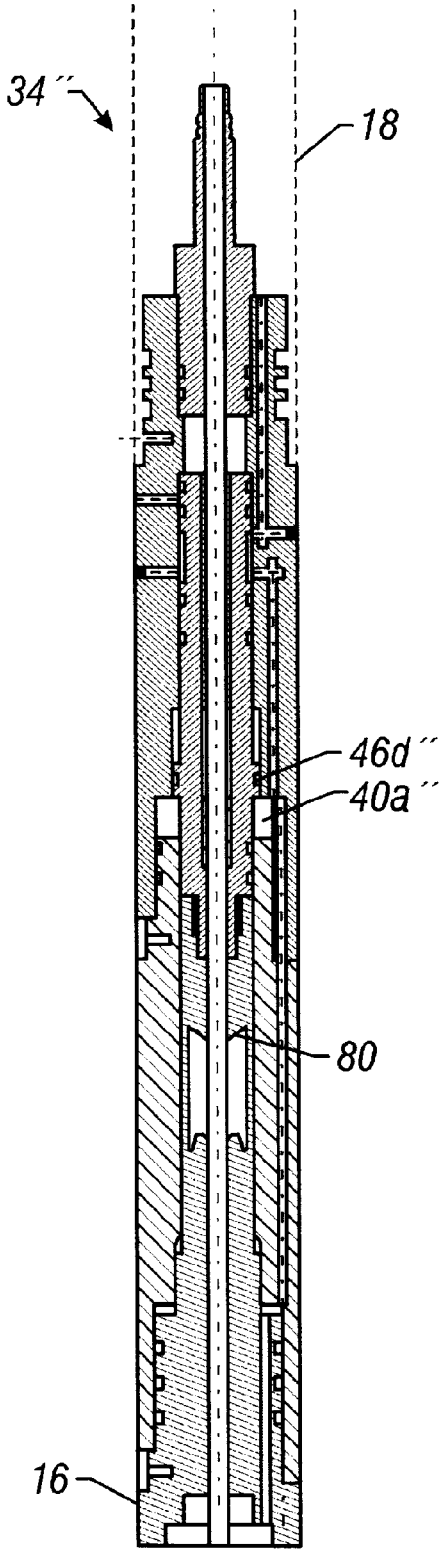

Although shown only with respect to the MSC valve, the constructions illustrated in FIGS. 9–11 may be applied to the MSO valve disclosed in FIGS. 2 and 3 to create MSO valves without any ports through the side walls of its housing for communicating with the well bore.

The valves disclosed herein are also useful in combination with guns which have external conduit (tubing run outside the gun housing, away from the direction of the charges) or with guns which otherwise are constructed to avoid breaching the internal tubing pressure conduit upon detonation. MSC valve 34, for instance, is useful for enabling recirculation during retrieval even if not needed to close an internal line. For instance, even tubing lines through guns which are intended to be opened to well bore pressure upon gun detonation to enable circulation flow can occasionally be shot through in such a way that the severed ends of the lines are sufficiently closed off to prevent flow. Additionally, MSO 30 and MSC 34 can provide additional reliability in such systems by closing off the activation system in the event of an unanticipated conduit breach upon detonation, or by disarming a leaky gun before firing.

The MSC and MSO valves discussed herein are also useful in combination with other types of ballistically activated tools, such as tools to set bridge plugs or packers, and in many various tool string configurations.

Other embodiments are also within the scope of the following claims.

What is claimed is:

1. A shut-off valve for use in a downhole string of tools in a well, the valve comprising a housing having two ends adapted to be connected to adjacent tools of the string, the housing defining therethrough a bore between the two ends, and a passage for hydraulic communication between the two ends, the passage intersecting the bore; and a piston slidably disposed within the bore and defining therethrough a bore for ballistic communication between the two housing ends, the piston arranged to block hydraulic communication between the passage and the piston bore, the piston further arranged to, in a first position, permit hydraulic communication along the passage, and to, in a second position, block hydraulic communication along the passage.

2. The shut-off valve of claim 1 wherein the piston is adapted to be moved by housing bore pressure from the first position to the second position.

3. The shut-off valve of claim 1 further comprising a lock to retain the piston in the second position after the piston is moved from its first position.

4. The shut-off valve of claim 1 further comprising a first ballistic element attached to the piston at one end thereof, and a second ballistic element attached to the said housing, such that said first and second ballistic elements are relatively moved away from each other as the piston moves to said second position.

5. The shut-off valve of claim 4 further comprising a shield attached to the housing along its bore between said first and second ballistic elements and arranged to shield said second ballistic element from a detonation of said first ballistic element when the piston is in said second position.

6. The shut-off valve of claim 5 wherein said shield is pivotably attached to the housing and is biased toward a detonation-blocking position.

7. The shut-off valve of claim 1 wherein the housing defines a port between its bore and a region at an ambient well pressure, the piston arranged to, in said first position, block hydraulic communication between the port and the passage and, in said second position, permit hydraulic communication between the port and the passage.

8. The shut-off valve of claim 1 wherein the piston and housing define therebetween an air chamber which is arranged to decrease in volume as the piston moves to said second position.

9. The shut-off valve of claim 1 wherein the piston defines a first transverse area exposed to ambient well pressure, such that ambient well pressure acts to force the piston toward its first position; and a second transverse area exposed to housing passage pressure, such that passage pressure acts to force the piston toward its second position.

10. The shut-off valve of claim 1, wherein the housing includes one or more housing sections.

11. The shut-off valve of claim 1, wherein the passage includes a first set of one or more passage portions in the upper end of the housing and a second set of one or more passage portions in the lower end of the housing, the first set and second set of one or more passage portions communicating through the housing bore.

12. The shut-off valve of claim 11, wherein the piston when in the second position is adapted to block communication through the housing bore between the first set and second set of one or more passage portions.

13. A shut-off valve for use between two tools of a downhole string of tools in a well, the valve comprising a housing having an inner bore and adapted to be connected to said two tools, the housing defining therethrough a passage for hydraulic communication between the two tools, the passage intersecting and crossing the housing bore; and a piston slidably disposed within the bore and having a first ballistic element for transferring a detonation between the two tools, the piston arranged to, in a first position, permit hydraulic communication along the passage, and to, in a second position, block hydraulic communication along the passage.

14. The shut-off valve of claim 13, wherein the housing includes one or more housing sections.

15. A string of tools to be lowered into a well on tubing for performing a series of downhole functions, the string defining a hydraulic conduit therein extending along the string for hydraulic communication between the tubing and tools of the string, the string comprising a hydraulically-activatable tool adapted to be activated by pressure conditions within the conduit;

a hydraulically-activatable firing head disposed below said tool and adapted to be activated by pressure conditions within the conduit;

a ballistically-activatable tool disposed below the firing head and adapted to be activated by a ballistic detonation from the firing head; and a shut-off valve disposed between the firing head and the ballistically-activatable tool, the valve comprising a housing having an inner bore and defining therethrough a passage forming a portion of the conduit, the passage intersecting the bore; and a piston slidably disposed within the housing bore and defining therethrough a bore for transferring said detonation, the piston arranged to, in a first position, permit hydraulic communication along the passage, and to, in a second position, block hydraulic communication along the passage, the piston adapted to be moved to said second position as a result of said detonation to enable the subsequent hydraulic activation of said hydraulically-activatable tool.

16. A method of performing a downhole function in a well with a string of tools, the method comprising assembling the string of tools to include a shut-off valve between two tools of the string, the shut-off valve comprising a housing having an inner bore and defining therethrough a passage for hydraulic communication between the two tools, the passage intersecting the bore; and a piston slidably disposed within the housing bore and defining therethrough a bore for ballistic communication between the two tools, the piston arranged to block hydraulic communication between the passage and the piston bore and to, in a first, as assembled position, permit hydraulic communication along the passage, and to, in a second position, block hydraulic communication along the passage;

lowering the assembled string of tools into a well; and initiating a detonation through the shut-off valve, said detonation causing the piston to be moved to said second position to block hydraulic communication along the passage.

17. The method of claim 15 wherein the two tools comprise a hydraulically-activatable firing head and a ballistically-activatable tool.

18. The method of claim 16 wherein the string of tools contains at least one hydraulically-activatable tool above the firing head, the method further comprising, after the step of initiating said detonation, the step of applying pressure to an upper end of said passage to activate said at least one hydraulically-activatable tool.

19. A method for use in a well, comprising:

lowering a tool string including at least a first tool and a second tool and at least a valve between the first and second tools, the valve providing a fluid passage between the first tool and second tool;

communicating pressure through the fluid passage to activate the second tool;

actuating a member in the at least one valve between a first position and a second position to block communication through the fluid passage upon activation of the second tool.

* * * * *